US007765645B2

(12) United States Patent
Kim

(10) Patent No.: US 7,765,645 B2
(45) Date of Patent: Aug. 3, 2010

(54) REFRIGERATOR

(75) Inventor: Jin Man Kim, Changrvon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/119,955

(22) Filed: May 13, 2008

(65) Prior Publication Data

US 2008/0284301 A1 Nov. 20, 2008

(30) Foreign Application Priority Data

May 14, 2007 (KR) ..... 10-2007-0046385

(51) Int. Cl.
*A45C 3/00* (2006.01)

(52) U.S. Cl. ..... 16/412; 312/405

(58) Field of Classification Search ..... 16/412, 16/430, 110.1, 436, 431, 111.1; 312/450, 312/405; 220/755, 770; 62/440; 49/276–278
See application file for complete search history.

(56) References Cited

U.S. PATENT DOCUMENTS 2,143,575 A * 1/1939 Raymond ..... 292/223
2,659,115 A * 11/1953 Anderson et al. ..... 49/277
3,091,946 A * 6/1963 Kesling ..... 62/465
5,906,423 A * 5/1999 Lyu ..... 312/405
5,908,228 A * 6/1999 Lee ..... 312/405
5,915,805 A * 6/1999 Lee ..... 312/405
6,338,536 B1 * 1/2002 Ueno et al. ..... 312/405
6,375,291 B1 * 4/2002 Nam et al. ..... 312/405
2005/0200253 A1 * 9/2005 Wissinger et al. ..... 312/405
2006/0043852 A1 * 3/2006 Kwon ..... 312/405
2008/0066481 A1 * 3/2008 An et al. ..... 62/265
2008/0282505 A1 * 11/2008 Kim ..... 16/412

* cited by examiner

*Primary Examiner*—William L. Miller
(74) *Attorney, Agent, or Firm*—Birch, Stewart, Kolasch & Birch, LLP

(57) ABSTRACT

A refrigerator is provided. The refrigerator includes an opening assist. The opening assist includes a connecting rod and a push rod. The opening assist is disposed in a door handle. The opening assist can be rotated by a user so as to push an end of the opening assist against a main body of the refrigerator for opening a door of the refrigerator. Therefore, the door of the refrigerator can be opened and closed more easily, and thus user can use the refrigerator more conveniently.

11 Claims, 3 Drawing Sheets

[fig.1]
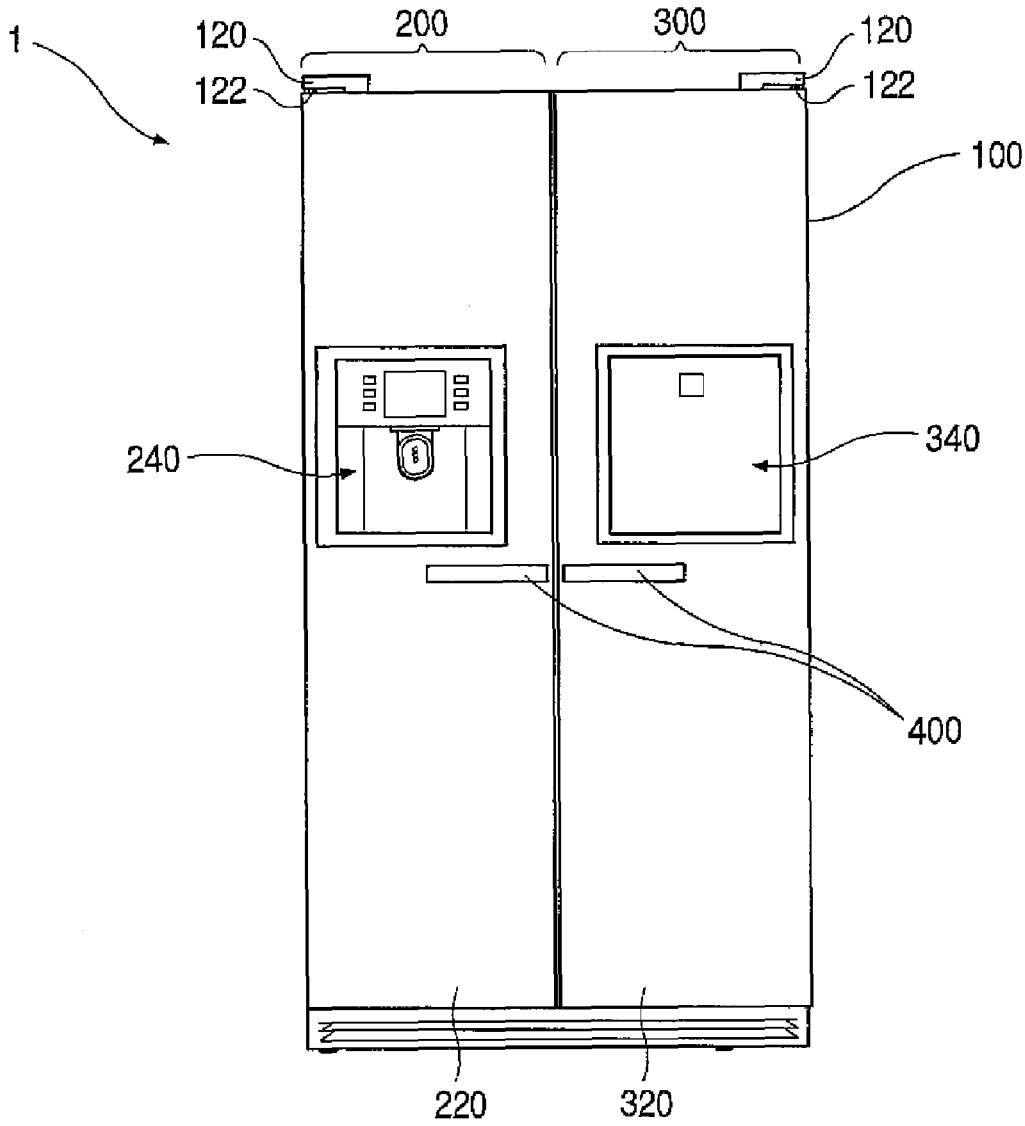

[fig.2]
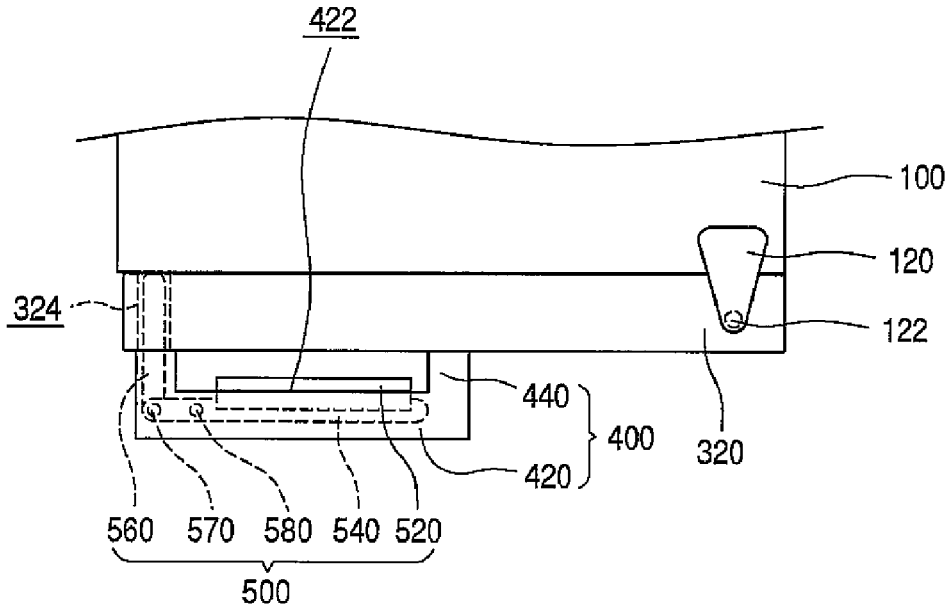
[fig.3]
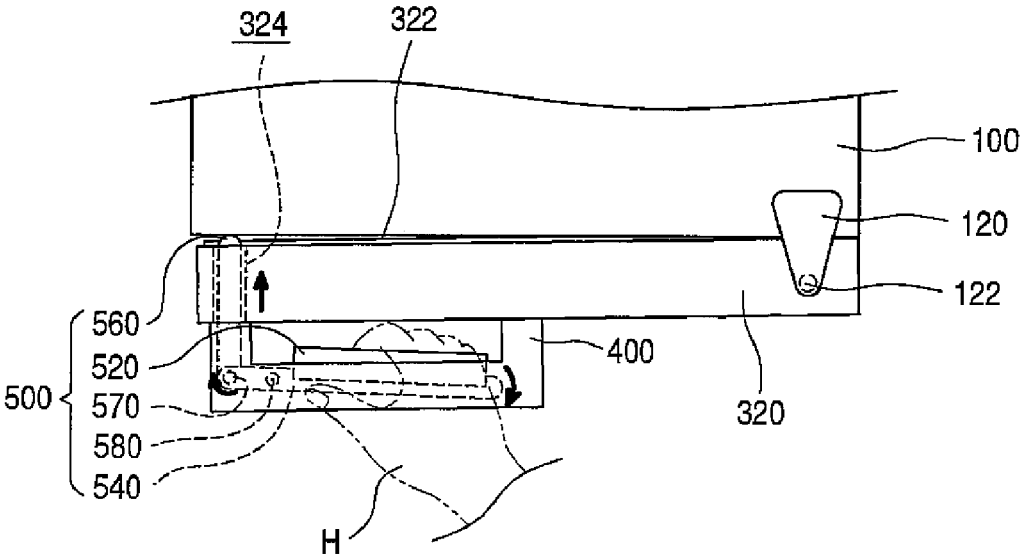

[fig.4]
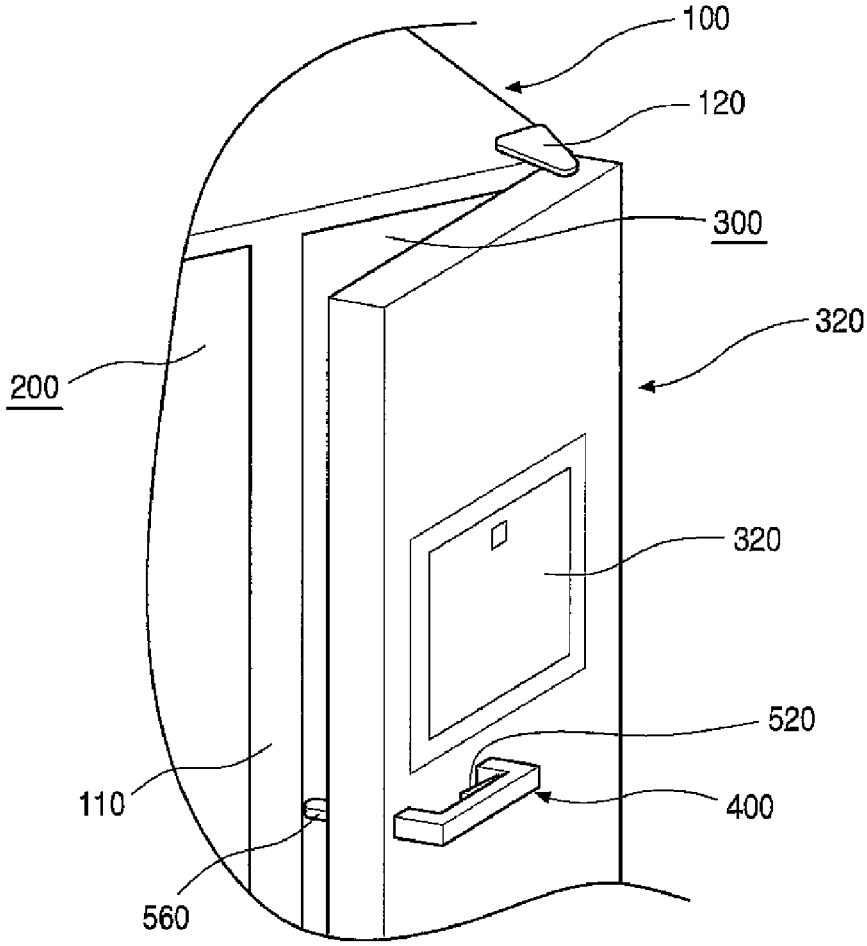
[fig.5]
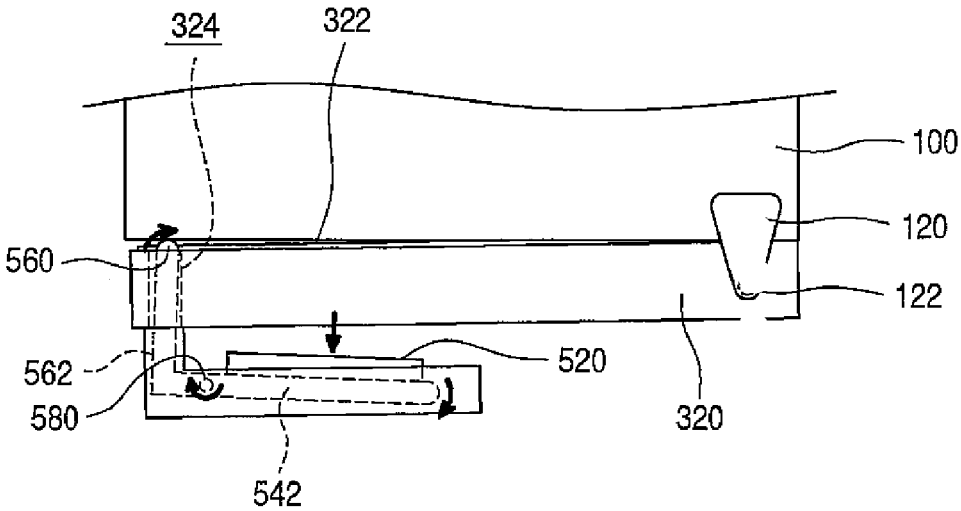

REFRIGERATOR

CROSS-REFERENCE TO RELATED APPLICATIONS

The present application claims priority under 35 U.S.C. 119 and 35 U.S.C. 365 to Korean Patent Application No. 10-2007-0046385 (May 14, 2007).

BACKGROUND

The present disclosure relates to a refrigerator door opening structure, and more particularly, to a refrigerator door opening structure including an opening assist disposed in a door handle for spacing a door apart from a main body when opening the door.

In general, as an apparatus for storing foods at low temperatures, a refrigerator preserves food in a frozen or refrigerated state according to the type and condition of the food.

Cold air supplied to the refrigerator is generated through heat exchange with refrigerant. That is, while a compression-condensation-expansion-evaporation cycle of refrigerant is being repeated, the refrigerant takes heat from air circulating in the refrigerator for decreasing the inside temperature of the refrigerator. By controlling this operation, the inside temperature of the refrigerator can be kept at an optimal low level for keeping food fresh.

Due to changes in eating habits and broadening palates of consumers, refrigerators are being enlarged and given more functions. Accordingly, the positions of a refrigerator compartment and a freezer compartment and the structures of doors for opening and closing the compartments have been diversified.

In general, refrigerators can be categorized into top mount type refrigerators, bottom freezer type refrigerators, and side-by-side type refrigerators. The top mount type refrigerator is the most proliferously used type with the freezer compartment above the refrigerator compartment. In the bottom freezer type refrigerator, the freezer compartment is disposed below the refrigerator compartment. In the side-by-side type refrigerator, the freezer and refrigerator compartments are positioned to the left and right of one another. Moreover, specialty refrigerators have been introduced that are configured specifically for the type of items they are intended to store, such as kimchi refrigerators for preserving kimchi and wine refrigerators for preserving wine.

These various types of refrigerators have a door for opening and closing a storage room of a main body. For example, a rotation type door can be opened and closed by rotating it left and right or upward and downward, and a drawer type door can be opened and closed by sliding it forward and backward.

Such a door includes a door handle so that a user can easily handle the door using the door handle for opening and closing the storage room.

A gasket is disposed between the door and the main body for preventing leakage of cold air. Owing to the gasket, when the door is closed, the storage room can be sealed more reliably. If necessary, a magnetic gasket can be used, which can make tight contact with the main body using a magnetic force for improving sealing effect.

A Large refrigerator has a heavy door, and pressure within the refrigerator drops when the inner temperature of the refrigerator drops so that the door makes contact with a main body of the refrigerator more firmly. Therefore, the act of opening the door may be difficult for some users (e.g., the old, women, children), thereby lowering convenience of use.

SUMMARY

In one embodiment, a refrigerator includes: a main body including a storage room; a door configured to selectively close and open the storage room; a hollow door handle attached to the door so as to allow a user to hold the door handle for opening the door; a connecting rod coupled to an inside of the door handle using a shaft; and a push rod coupled to an end portion of the connecting rod by shaft coupling so as to be translationally moved according to a movement of the connecting rod, the push rod being configured to be pushed against the main body for spacing the door from the main body.

In another embodiment, a refrigerator includes: a main body including a storage room; a door configured to selectively close and open the storage room; a door handle attached to the door so as to allow a user to hold the door handle for opening the door; and an opening assist including a gripping part and a push part, the gripping part being coupled to an inside of the door handle using a shaft for being pressed by a user when the user holds the door handle, the push part extending from an end of the gripping part toward the main body through the door for being pushed against the main body according to a movement of the gripping part.

The details of one or more embodiments are set forth in the accompanying drawings and the description below. Other features will be apparent from the description and drawings, and from the claims.

BRIEF DESCRIPTION OF THE DRAWINGS

FIG. 1 is a perspective view illustrating a refrigerator according to an embodiment.

FIG. 2 is a partial top phantom view illustrating the refrigerator according to an embodiment.

FIG. 3 is a partial top phantom view illustrating the refrigerator when a refrigerator door starts to be opened, according to an embodiment.

FIG. 4 is a partial perspective view illustrating the refrigerator when the refrigerator door is partially opened, according to an embodiment.

FIG. 5 is a partial top phantom view illustrating a refrigerator when a refrigerator door starts to be opened, according to another embodiment.

DETAILED DESCRIPTION OF THE EMBODIMENTS

Reference will now be made in detail to the embodiments of the present disclosure, examples of which are illustrated in the accompanying drawings. The present disclosure may, however, be embodied in many different forms and should not be construed as being limited to the embodiments set forth herein.

In the following description, a refrigerator compartment door of a side-by-side type refrigerator is described as an example. However, the description can be applied to other refrigerators such as a top mount type refrigerator and a bottom mount type refrigerator.

FIG. 1 is a perspective view illustrating a refrigerator 1 according to an embodiment.

Referring to FIG. 1, the refrigerator 1 of the current embodiment includes a main body 100 having a cuboid shape. The inside of the main body 100 is divided by a barrier 110 (refer to FIG. 4) into a freezer compartment 200 and a refrigerator compartment 300.

Front sides of the freezer compartment 200 and the refrigerator compartment 300 are opened. A freezer compartment door 220 is attached to the opened front side of the freezer compartment 200, and a refrigerator compartment door 320 is attached to the opened front side of the refrigerator compartment 300.

In detail, the freezer compartment door 220 and the refrigerator compartment door 320 are rotatably installed using hinges 120 including shafts 122. The hinges 120 are disposed at left and right top edge portions of the main body 100, respectively. The freezer compartment door 220 can be opened by rotating it to the left, and the refrigerator compartment door 320 can be opened by rotating it to the right. The freezer compartment door 220 and the refrigerator compartment door 320 can be individually operated.

Gaskets 322 (refer to FIG. 3) are disposed along edges of rear surfaces of the freezer compartment door 220 and the refrigerator compartment door 320. when the freezer compartment door 220 and the refrigerator compartment door 320 are closed, the gaskets 322 make tight contact with the main body 100 for improving sealing performance. The gaskets 322 include magnets such that the gaskets 322 can make tight contact with a steel-portion of the main body 100.

If necessary, a dispenser 240 can be disposed at a front surface of the freezer compartment door 220 for dispensing purified water or ice cubes. In addition, a home bar 340 may be disposed at a front surface of the refrigerator compartment door 320 for allowing a user to place food into the refrigerator compartment 300 and take food out of the refrigerator compartment 300 through the home bar 340 without having to open the refrigerator compartment door 320.

Door handles 400 are disposed at the front surfaces of the freezer compartment door 220 and the refrigerator compartment door 320. Users can easily open the freezer compartment door 220 and the refrigerator compartment door 320 using the door handles 400. The door handles 400 are disposed under the dispenser 240 and the home bar 340, respectively.

FIG. 2 is a partial top phantom view illustrating the refrigerator 1 according to an embodiment.

The door handles 400 have the same structure for the freezer compartment door 220 and the refrigerator compartment door 320. Only the locations of the door handles 400 are different. Thus, in the following description, the door handle 400 disposed at the refrigerator compartment door 320 will be mainly described as an example.

Referring to FIG. 2, the hinge 120 is disposed at the right top edge portion of the main body 100 of the refrigerator 1 so as to allow the refrigerator compartment door 320 to be rotated to the right for opening the refrigerator compartment 300. A portion of the hinge 120 is fixed to the main body 100, and the other portion of the hinge 120 including the shaft 122 is fixed to the refrigerator compartment door 320 so as to allow the refrigerator compartment door 320 to be rotated on the shaft 122.

As mentioned above, the door handle 400 is disposed at the refrigerator compartment door 320. The door handle 400 includes an opening assist 500 for facilitating an opening operation of the refrigerator compartment door 320.

A gap is formed between the door handle 400 and the front surface of the refrigerator compartment door 320 so that a user can easily hold the door handle 400. For this, the door handle 400 includes a handle part 420 and extension parts 440. The handle part 420 is a gripping part. The extension parts 440 extend from both ends of the handle part 420 to the front surface of the refrigerator compartment door 320 and are attached to the front surface of the refrigerator compartment door 320. The door handle 400 has a hollow shape. For example, the door handle 400 has a hollow circular or polygonal cross section.

The opening assist 500 is disposed in the hollow door handle 400 for easily spacing the refrigerator compartment door 320 apart from the main body 100. An exposing portion 422 is formed in the handle part 420 of the door handle 400, and a press part 520 is partially exposed through the exposing portion 422.

A penetration hole 324 is formed through the refrigerator compartment door 320 at a position corresponding to the extension part 440. A push rod 560 is disposed in the penetration hole 324. The push rod 560 can be moved forwardly and backwardly in the penetration hole 324. The penetration hole 324 may communicate with a hole formed through the extension part 440.

The opening assist 500 is disposed in the door handle 400. The opening assist 500 includes the press part 520, the push rod 560, and a connecting rod 540. The press part 520 is partially exposed through a rear surface of the door handle 400. The push rod 560 can be selectively pushed against the main body 100 by manipulating the press part 520. The connecting rod 540 connects the press part 520 and the push rod 560.

In detail, the press part 520 is connected to the connecting rod 540 in a center portion of the door handle 400 and is partially exposed through the exposing portion 422 of the door handle 400.

Therefore, a pressing force applied to the press part 520 can be transmitted to the connecting rod 540. Although the press part 520 has a rectangular shape in the embodiment of FIG. 2, the press part 520 can have other shapes such as a concave-convex shape for allow a user to hold the press part 520 more easily.

As explained above, the press part 520 is connected to an end portion of the connecting rod 540, and the push rod 560 is connected to the other end portion of the connecting rod 540 using a coupling member 570. The connecting rod 540 is disposed in the door handle 400 and rotatable on a fixing pin 580.

In more detail, the fixing pin 580 is disposed at a side (a left side in FIG. 2) of the connecting rod 540 for fixing the connecting rod 540 to the door handle 400.

Therefore, when the press part 520 is pushed, the connecting rod 540 is rotated on the fixing pin 580 within the inside of the door handle 400 by a predetermined angle.

The push rod 560 is connected to the connecting rod 540 by the coupling member 570. Thus, when the press part 520 is pushed, the push rod 560 is translationally moved in the extension part 440 and the penetration hole 324. The push rod 560 is configured to be pushed against the main body 100 for easily opening the refrigerator compartment door 320. The push rod 560 is rotatably connected to the end portion of the connecting rod 540 by the coupling member 570. For this, the coupling member 570 may have a pin or shaft shape.

The coupling member 570 is not coupled to the door handle 400. Thus, when a pressing force is transmitted from to the press part 520 to the push rod 560 through the connecting rod 540, the fixing pin 580 functions as a stationary rotation center of the connecting rod 540.

It will now be specifically described how the refrigerator compartment door 320 is opened.

FIG. 3 is a partial top phantom view illustrating the refrigerator 1 when the refrigerator compartment door 320 starts to be opened, according to an embodiment, and FIG. 4 is a partial perspective view illustrating the refrigerator 1 when the refrigerator compartment door 320 is partially opened, according to an embodiment.

Referring to FIGS. 3 and 4, a user can hold and pull the door handle 400 to open the refrigerator compartment door 320 for accessing food stored in the refrigerator 1.

When the user holds and pulls the door handle 400, a rear center portion of the door handle 400 is pressed. That is, the press part 520 protruding from the inner rear surface of the handle part 420 is pressed.

The pressing force applied to the press part 520 is transmitted to the connecting rod 540. Then, the right end portion of the connecting rod 540 is rotated downward on the fixing pin 580, and the left end portion of the connecting rod 540 is rotated upward on the fixing pin 580 as shown in FIG. 3.

Therefore, the push rod 560, which connected to the left end portion of the connecting rod 540 through the coupling member 570, is pushed toward the main body 100 by the connecting rod 540 and is brought into contact with the main body 100. Subsequently, the push rod 560 is pushed against the main body 100 to space the refrigerator compartment door 320 apart from the main body 100, and thus the refrigerator compartment door 320 is opened.

In detail, when the refrigerator compartment door 320 is opened, the gasket 322 disposed between the refrigerator compartment door 320 and the main body 100 is spaced apart from the main body 100 by the push rod 560. This breaks the sealing of the refrigerator compartment 300 accomplished by a magnetic force of the gasket 322 and allows outside air to enter the refrigerator compartment 300. Therefore, the inside pressure of the refrigerator compartment 300 can be balanced with the outside atmospheric pressure, and thus a user can open the refrigerator compartment door 320 more easily.

When the user closes the refrigerator compartment door 320 after taking food out of the refrigerator compartment 300, the push rod 560 protruding from a rear surface of the refrigerator compartment door 320 is brought into contact with the main body 100 and is retracted. Then, the right end portion of the connecting rod 540 is rotated backward toward the main body 100, and thus the press part 520 is extended backward through the exposing portion 422 to its original position.

Although embodiments have been described with reference to a number of illustrative embodiments thereof, it should be understood that numerous other modifications and embodiments can be devised by those skilled in the art that will fall within the spirit and scope of the principles of this disclosure.

For example, the opening assist 500 may be provided in one piece. Another embodiment will now be described in detail with reference to the accompanying drawing.

In the current embodiment, all elements have the same structures as those in the previous embodiments except for an opening assist and a door handle. Thus, the same elements will be denoted by the same reference numerals, and descriptions thereof will be omitted.

FIG. 5 is a partial top phantom view illustrating the refrigerator 1 when the refrigerator compartment door 320 starts to be opened, according to another embodiment.

Referring to FIG. 5, a hollow door handle 400 is attached to the front surface of the refrigerator compartment door 320. The door handle 400 includes a handle part 420 and an extension part 440. The handle part 420 is a gripping part. The extension part 440 extends from an end of the handle part 420 to the front surface of the refrigerator compartment door 320 and is attached to the front surface of the refrigerator compartment door 320 so that the handle part 420 can be spaced apart from the front surface of the refrigerator compartment door 320.

An opening assist 500 is disposed in the door handle 400. The opening assist 500 includes a gripping part 542 and a push part 562. The gripping part 542 has horizontally elongated shape, and the push part 562 extends perpendicularly from an end of the gripping part 542. That is, the opening assist 500 is shaped like a rod having a perpendicularly bent end portion and is installed in the door handle 400.

The gripping part 542 is disposed in the handle part 420 of the door handle 400. A press part 520 is formed on the gripping part 542. The press part 520 is exposed to the outside of the handle part 420. The press part 520 exposed through an opening of the handle part 420 so that when a user holds the handle part 420, the press part 520 can be naturally pressed.

The push part 562 is disposed in the extension part 440 and is longer than the extension part 440. The push part 562 is inserted in the penetration hole 324 of the refrigerator compartment door 320. The push part 562 can be selectively pushed against the front surface of the main body 100 through the penetration hole 324 by handling the gripping part 542. A fixing pin 580 is coupled to a bent portion of the opening assist 500 between the gripping part 542 and the push part 562 so as to fix the opening assist 500 and allow rotation of the opening assist 500.

That is, the fixing pin 580 fixes the opening assist 500 to an inside area of the door handle 400 and allows rotation of the opening assist 500 so that the push part 562 can be selectively pushed against the main body 100 by handling the gripping part 542.

Owing to the fixing pin 580, a distal end of the push part 562 can be selectively exposed from the rear surface of the refrigerator compartment door 320 when the gripping part 542 is rotated. For this, the fixing pin 580 is inserted through a portion of the gripping part 542 between a center portion of the gripping part 542 and an end portion of the gripping part 542 where the push part 562 extends from the gripping part 542. Then, the fixing pin 580 is inserted through and coupled to a predetermined position of the door handle 400.

Therefore, when a user holds and pulls the door handle 400 to open the refrigerator compartment door 320, the press part 520 is naturally pressed, and the gripping part 542 is rotated. Then, the distal end of the push part 562 is brought into contact with the main body 100.

If the press part 520 is further pressed, the push part 562 is pushed against the main body 100. Then, the refrigerator compartment door 320 is spaced apart from the main body 100. In this way, the refrigerator compartment door 320 can be easily opened.

As described above, when a user holds and pulls the door handle 400 of the refrigerator 1, the press part 520 is naturally pressed. Thus, the push rod 560 or the push part 562 is pushed against the main body 100 so that the refrigerator compartment door 320 can be opened more easily.

In addition, since the press part 520 is configured to receive a pressing force in a direction in which a user pulls the door handle 400 so that the user can press the press part 520 more easily.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body comprising a storage room;

a door configured to selectively close and open the storage room;

a hollow door handle attached to the door so as to allow a user to hold the door handle for opening the door;

a connecting rod coupled to an inside of and within the hollow door handle using a fixing pin; and a push rod coupled to an end portion of the connecting rod by a shaft coupling so as to be translationally moved according to a movement of the connecting rod, the push rod being configured to be pushed against the main body for spacing the door from the main body.

2. The refrigerator according to claim 1, wherein the fixing pin is located away from a rotation center of the connecting rod toward the push rod.

3. The refrigerator according to claim 1, wherein an opening is formed in a rear surface of the door handle as an exposing portion for partially exposing the inside of the door handle.

4. The refrigerator according to claim 3, further comprising a press part protruding from the connecting rod to be exposed through the exposing portion.

5. The refrigerator according to claim 1, wherein the door comprises a penetration hole formed through a front to a rear surface of the door for receiving the push rod, and the penetration hole communicates with a hollow of the door handle in which the push rod is disposed.

6. A refrigerator comprising:

a main body comprising a storage room;

a door configured to selectively close and open the storage room;

a door handle attached to the door so as to allow a user to hold the door handle for opening the door;

an opening assist comprising a gripping part and a push part, the gripping part being coupled to an inside of the door handle using a fixing pin and for being pressed by a user when the user holds the door handle, the push part extending from an end of the gripping part toward the main body through the door for being pushed against the main body according to a movement of the gripping part; and a press part protruding outward from the gripping part through a portion of the door handle so as to be pressed by a user.

7. The refrigerator according to claim 6, wherein the door handle is hollow and comprises:

a handle part provided for a user to hold; and an extension part extending from each end portion of the handle part so as to space the handle part apart from the door.

8. The refrigerator according to claim 7, wherein the gripping part is disposed in the handle part, and the push part is disposed in the extension part.

9. The refrigerator according to claim 6, wherein the fixing pin is disposed between a longitudinal center of the gripping part and the end of the gripping part from which the push part extends so as to allow rotation of the opening assist, the fixing pin being inserted through the door handle and coupled to the door handle.

10. The refrigerator according to claim 6, wherein the push part and the gripping part extend from a mutually crossing point.

11. The refrigerator according to claim 6, wherein the push part and the gripping part are formed integrally.

* * * * *